US005505067A

United States Patent [19]

Thomas et al.

[11] Patent Number: 5,505,067

[45] Date of Patent: Apr. 9, 1996

[54] NON-CONTACT DOUBLE-BLOCK SPEED CONTROLLER

[75] Inventors: Kenneth J. Thomas, Greene, R.I.; Frederick W. Hall, Ossipee, N.H.

[73] Assignee: Waddington Electronics, Inc., Cranston, R.I.

[21] Appl. No.: 271,419

[22] Filed: Jul. 6, 1994

[51] Int. Cl.[6] ..... B21C 1/12

[52] U.S. Cl. ..... 72/20.1; 72/280; 72/289; 367/96

[58] Field of Search ..... 72/280, 279, 288, 72/289, 21; 367/96

[56] References Cited

U.S. PATENT DOCUMENTS

| | | | |
|---|---|---|---|
| 2,271,187 | 2/1942 | Dahistrom | 72/279 |
| 2,750,449 | 8/1973 | Rabe | 72/289 |
| 3,860,187 | 1/1975 | Liska et al. | 242/45 |
| 4,199,246 | 4/1980 | Muggli | 367/101 |
| 4,252,010 | 2/1981 | Rossi | 72/289 |
| 4,384,665 | 5/1983 | Waddington | 226/42 |
| 4,525,654 | 6/1985 | Tajima et al. | 318/7 |
| 4,528,651 | 7/1985 | Brock | 367/96 |
| 4,604,883 | 8/1986 | Schaetzke | 72/280 |
| 4,609,915 | 9/1986 | Erkens | 340/671 |
| 4,754,937 | 7/1988 | Hoddinott et al. | 242/128 |
| 4,829,790 | 5/1989 | Memminger et al. | 66/132 R |
| 5,015,300 | 5/1991 | Leers | 367/96 |
| 5,160,098 | 11/1992 | Durkos | 242/75 |

FOREIGN PATENT DOCUMENTS

| | | | |
|---|---|---|---|
| 2046648 | 11/1980 | United Kingdom | 72/289 |

*Primary Examiner*—Daniel C. Crane

*Attorney, Agent, or Firm*—Hamilton, Brook, Smith & Reynolds

[57] ABSTRACT

In cumulative wire-drawing machines comprising a plurality of dies for successively reducing a diameter of a wire and blocks downstream of each one of the dies for pulling the wire through the dies, the speed of the motor driving the blocks can be automatically controlled by a wire accumulation detection device that detects changes in the amount of wire accumulated on the double-block. Specifically in the context of a double-block type machine, the blocks each comprise a lower segment being driven by the motor to pull the wire through the die, an upper segment for providing the wire to a downstream double-block through a downstream die, and a sheave carried on a ring for transferring the wire from the lower segment to the upper segment. The wire accumulation detection device in this case comprises a cam on the ring and a proximity detection device mounted to the housing of the wire-drawing machine that detects the rotation of the ring by detecting a distance to a surface of the cam. This proximity detection device can be an ultrasonic transducer which emits an ultrasonic pulse towards the cam and then detects returning echo.

18 Claims, 4 Drawing Sheets

NON-CONTACT DOUBLE-BLOCK SPEED CONTROLLER

BACKGROUND OF THE INVENTION

The basic component of wire-drawing machines is the die through which wire or rod is drawn. The die does not remove any of the metal of the rod but uniformly reduces its cross-sectional area and at the same time improves the finish and physical properties. A block, comprising essentially a large motor driven spool, is positioned downstream of the die to pull the wire through the die by winding the wire around its outer circumference. In most cases, the wire or rod must be drawn through successive dies of progressively narrowing diameter so that the desired cross-sectional area can be achieved.

Before the advent of continuous machines, wire was drawn on drawing frames. These frames included a number of dies and blocks associated with each die. The length of wire of the desired diameter was produced by first drawing it through the largest die onto the block associated with that die and then once this process was completed, the wire was moved and drawn through the next die onto that die's block.

Continuous machines represent an improvement over the older wire-drawing frames. In these machines, the same length of wire is drawn continuously through a series of dies of decreasing diameter. Continuous wire-drawing machines are generally divided into two classes, cumulative and non-cumulative. Non-cumulative machines have a number of dies and blocks downstream of each die. Since the wire lengthens as it passes through the successive dies, each of the downstream blocks must be run at incrementally higher speeds while maintaining the necessary tensions to draw the wire through the blocks. The tensions are automatically controlled by providing dancers in between the blocks which sense tension on the wire. The speeds of the blocks are then automatically adjusted to maintain constant tensions.

The most common examples of a continuous cumulative-type wire-drawing machine are the multiple-draft double-block and overhead take-off (OTO) wire-drawing machines. These machines also have a number of dies and blocks downstream of each one of these dies. The blocks have a capability of dynamically accumulating small quantities of wire so that wire tension in the dies can be consistently maintained even as the wire length is increasing between the dies. The accumulation also allows cooling in between the dies so that the wire does not melt. The standard practice is that an operator controls the speeds of the blocks manually so that none of the blocks either runs out of nor accumulates too much wire.

SUMMARY OF THE INVENTION

The present invention is directed to a control device for controlling block speeds in multiple-draft continuous double-block or OTO wire-drawing machines. The device has the advantage that it can be easily incorporated into existing wire-drawing machines by simple modification of the mechanical elements and electrical circuits. Basically, the device regulates the motor speed of blocks by detecting changes in the quantity of wire accumulated on the blocks. In its specific embodiments described herein, the device is simple enough to be retrofitted onto existing machines. Although, it could also be incorporated easily into new machines.

In general, according to one aspect, the invention is adapted for a cumulative wire-drawing machine including a die for reducing a diameter of a wire, a block for pulling the wire through the die, and a motor for driving the block. The invention is a block speed controlling device that comprises a wire accumulation detection device for generating a signal indicative of changes in the amount of wire accumulated on the block and a motor speed control for changing the speed of the motor in response to the signal.

In specific embodiments, the wire-drawing machine is of the double-block type which comprises a first segment and a second segment for pulling the wire through the die and for providing the wire to a downstream die, respectively, and a sheave for transferring the wire from the first segment to the second segment. Also, the double-block comprises a ring rotating on an axis of rotation of the first segment and the second segment for carrying the sheave. In this specific context, the wire accumulation detecting device detects changes in the amount of wire accumulated on the double-block by detecting rotation of the ring.

In other embodiments, the wire accumulation detecting device comprises a cam on the ring and a proximity detection device mounted on a housing of the wire-drawing machine that detects rotation of the ring by detecting a distance to a surface of the cam. This proximity detection device can be an ultra-sonic transducer for generating an ultrasonic signal and then detecting the echo signal from the cam.

In general, according to another aspect, the wire-drawing machine comprises a plurality of dies for successively reducing a diameter of a wire. Downstream of each one of these dies, a double-block pulls wire through the dies. Each one of the double-blocks includes a motor, a first segment being driven by the motor to pull the wire through the die, a second segment for providing the wire to a downstream double-block through a downstream die, and a sheave for transferring the wire from the first segment to the second segment. A wire accumulation detecting device is provided in association with each one of the double-blocks. This device detects changes in the amount of wire accumulated on the double-block and generates a signal indicative of the changes. Then, a motor speed controlling device changes the speed of the motor in response to this signal.

In specific embodiments, the wire accumulation detecting device of the wire-drawing machine comprises a cam mounted on a ring carrying the sheave on the double-block and a proximity detector that detects a distance to a surface of the cam.

In general, according to a different aspect, the cumulative wire-drawing machine comprises a plurality of dies for successively reducing a diameter of a wire. A block is positioned downstream of each one of the dies to pull the wire through the dies and accumulate the wire. Each one of the blocks includes a motor, a segment being driven by the motor to pull the wire through the die and accumulate the wire, and a sheave for transferring the wire from the segment. A wire accumulation detecting device associated with each block detects changes in an amount of wire accumulated on the block and generates a signal indicative of the changes. Then, a motor speed controlling device changes the speed of the motor in response to the signal.

In specific embodiments, the wire accumulation detecting device comprises a cam on the ring and a proximity detection device mounted on the housing of the wire-drawing machine for detecting rotation of the ring by detecting a distance to a surface of the cam to detect the changes in the amount of wire accumulated on the block.

In general, according to still another aspect, a method for retrofitting an overhead take-off wire-drawing machine for automatic control comprises steps of installing a cam on a ring carrying a sheave, the sheave for transferring wire from a segment of a block, and mounting a proximity detection device to a housing of the wire-drawing machine to detect a distance to an outer surface of the cam. Additionally, an electrical control circuit of a motor driving the block is modified to vary the speed of the block in response to a distance to the cam detected by the proximity detection device.

The above and other features of the invention including various novel details of construction and combinations of parts, and other advantages, will now be more particularly described with reference to the accompanying drawings and pointed out in the claims. It will be understood that the particular method and device embodying the invention is shown by way of illustration and not as a limitation of the invention. The principles and features of this invention may be employed in various and numerous embodiments without the departing from the scope of the invention.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numbers refer to the same parts throughout the different views. The drawings are not necessarily to scale, emphasis instead being placed upon illustrating the principles of the invention.

DETAILED DESCRIPTION OF THE DRAWINGS

Figure 1:
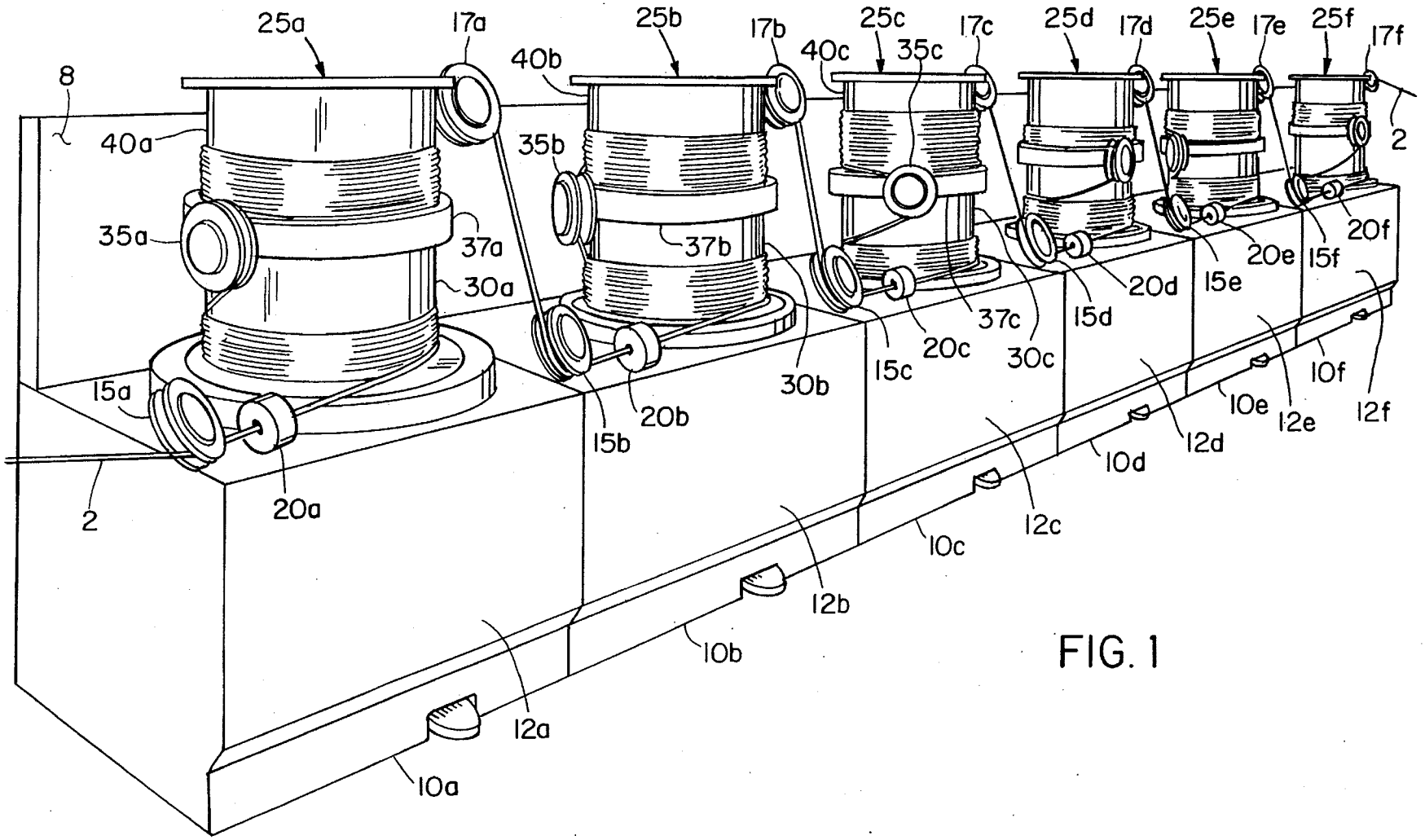
FIG. 1 is a perspective view of a prior art wire-drawing machine.

The features of a prior art double-block cumulative 6-draft continuous wire-drawing machine are illustrated in FIG. 1. Generally, six stations 10*a*–10*f* are provided in the wire-drawing machine for successively reducing the diameter of wire or bar 2 being fed into the machine. Each one of the stations 10*a*–10*f* has a first guide sheave 15*a*–15*f* for handling incoming wire and a second guide sheave 17*a*–17*f* for handling outgoing wire. Further, a die 20*a*–20*f* is provided downstream of the first guide sheave to reduce the diameter of the wire. From station to station, the dies 20*a*–20*f* have successively reduced diameters so that as the wire travels from station to station, its diameter is reduced until the desired specifications are achieved. Generally, however, the last dies 20*e* and 20*f* have basically the same diameter so that as the upstream die 20*e* wears, the downstream die 20*f* can still maintain the proper final diameter.

Each station 10*a*–10*f* also comprises a double-block 25*a*–25*f*. These double-blocks 25*a*–25*f* are required because of the basic characteristic that as the wire 2 passes through the dies, its speed increases because the decreased diameter causes a lengthening of the wire. The double-blocks 25*a*–25*f* have the ability to dynamically accumulate quantities of wire so that the wire can be maintained under tension both in the station's die and in a die of a downstream station.

Specifically, each double-block 25*a*–25*f* comprises a lower segment 30*a*–30*f* which is driven by its own motor 110 (not shown in this figure) contained in the station's base 12*a*–12*f*. This lower segment 30*a*–30*f* of the double-block 25*a*–25*f* is driven to essentially pull the wire through the die 20*a*–20*f*. A transfer sheave 35*a*–35*f* then transfers the wire to an upper segment 40a-40f. Although this upper segment is not driven by the station's motor, it rotates on the same axis as the lower segment 30*a*–30*f* but in an opposite direction since the wire it holds is being pulled downstream to a next station.

The transfer sheave 35*a*–35*f* is mounted to freely rotate on a ring 37*a*–37*f* which in turn is itself free to rotate on an axis that is co-axial with the axes of rotation of the lower and upper segments 30*a*–30*f* and 40*a*–40 *f*. It is a characteristic of the double-blocks that when the double-block is neither accumulating nor loosing the net amount of wire it holds, the transfer sheave remains at a fixed circumferential position around the double-block, i.e., the ring 37*a*–37*f* does not rotate. If, however, the double-block 25*b*, for example, is loosing the net amount of wire it is storing because the lower segment 30*c* of the double-block 25*c* is rotating more slowly than the lower segment 30*e* of the double-block 25*e*, the ring 37*b* will rotate in a clockwise direction so that the transfer sheave 35*b* rotates around the double-block 25*b*.

During the operation of the wire-drawing machine, the desired condition is that each double-block operates in a steady state condition. That is, all of the sheaves are stopped at a fixed circumferential position on their corresponding double-blocks. The conventional approach to achieve this state is to have an operator visually monitoring the wire-drawing machines and manually controlling each of the motors by a potentiometer speed control.

Figure 2:
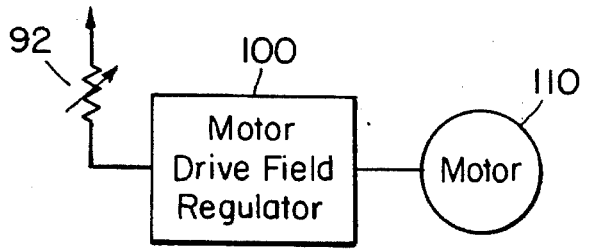
FIG. 2 is a block diagram of a circuit for controlling the speed of a single double-block in the prior art wire-drawing machine of FIG. 1.

As shown in FIG. 2, an operator's field adjust potentiometer 92 presents a variable voltage to a motor drive field regulator 100. This regulator 100 amplifies the variable voltage as a field voltage for controlling the speed of the motor 110 that drives the lower segment 30*a*–30*f* of a double-block 25*a*–25*f*. For example, by decreasing the voltage to the drive field regulator 100, the motor 110 can be slowed. An increase in this voltage by appropriately adjusting the potentiometer 92 will cause the motor to increase in speed. Each one of the stations 10*a*–10*f* shown in FIG. 1 has its own motor 110 whose speed is controlled by a circuit as shown in FIG. 2.

One problem with this approach, however, in addition to the associated cost of having an operator dedicated to constantly watching the wire-drawing machine, is that achieving the steady state condition can be difficult since whenever the speed of double-block 25*b*, for example, is adjusted either faster or slower, every other double-block must then also be re-adjusted to compensate for the fact that 25*b* is providing and consuming wire at a new rate. Further, speed adjustment is a constant process since as the dies slowly wear out less drag is placed on the wire so the motors tend to speed up and also because the wire is not lengthened to the same degree. Consequently, the machines are always moving out of adjustment. Moreover, since it is difficult to keep the machine in adjustment, it is even more difficult to adjust the machine to operate at its maximum speed. That is, maximum production occurs when the last double-block 25*f* is operating at its maximum speed. This state is difficult to obtain since it requires essentially the simultaneous adjustment of the other five blocks 25*a*–25*f*. Consequently, the conventional mode for operating the wire-drawing machine causes both suboptimal operation and requires the constant supervision by an operator.

The present invention is directed to an accumulation monitoring device that detects changes in the amount of wire accumulated on each double-block. In response to these changes, as detected by the device, the speeds of the motors that drive each of the double-blocks are adjusted to achieve a steady state condition.

Figure 4:
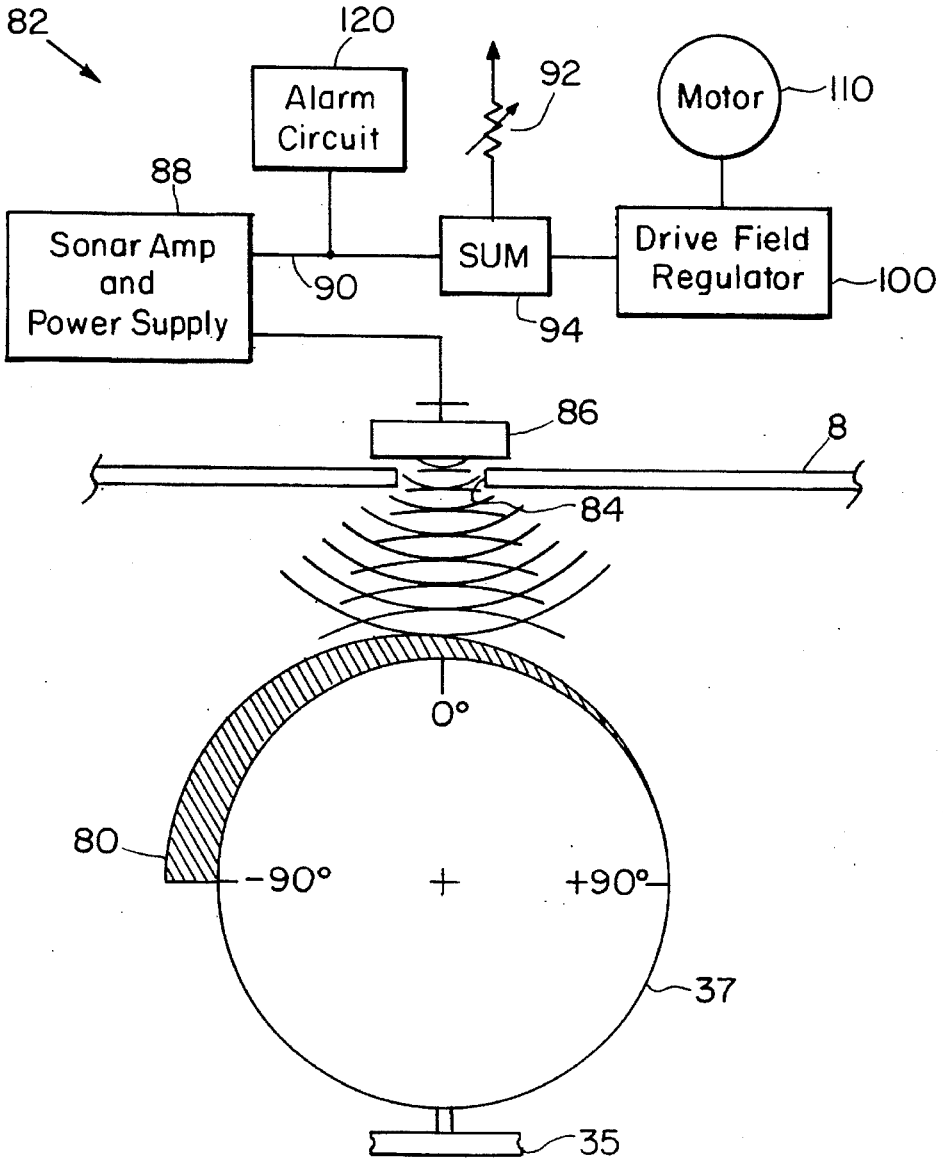
FIG. 4 is a schematic view showing a horizontal cross-section of the inventive double-block and in a wire-drawing machine modified according to the principles of the present invention.
Figure 3:
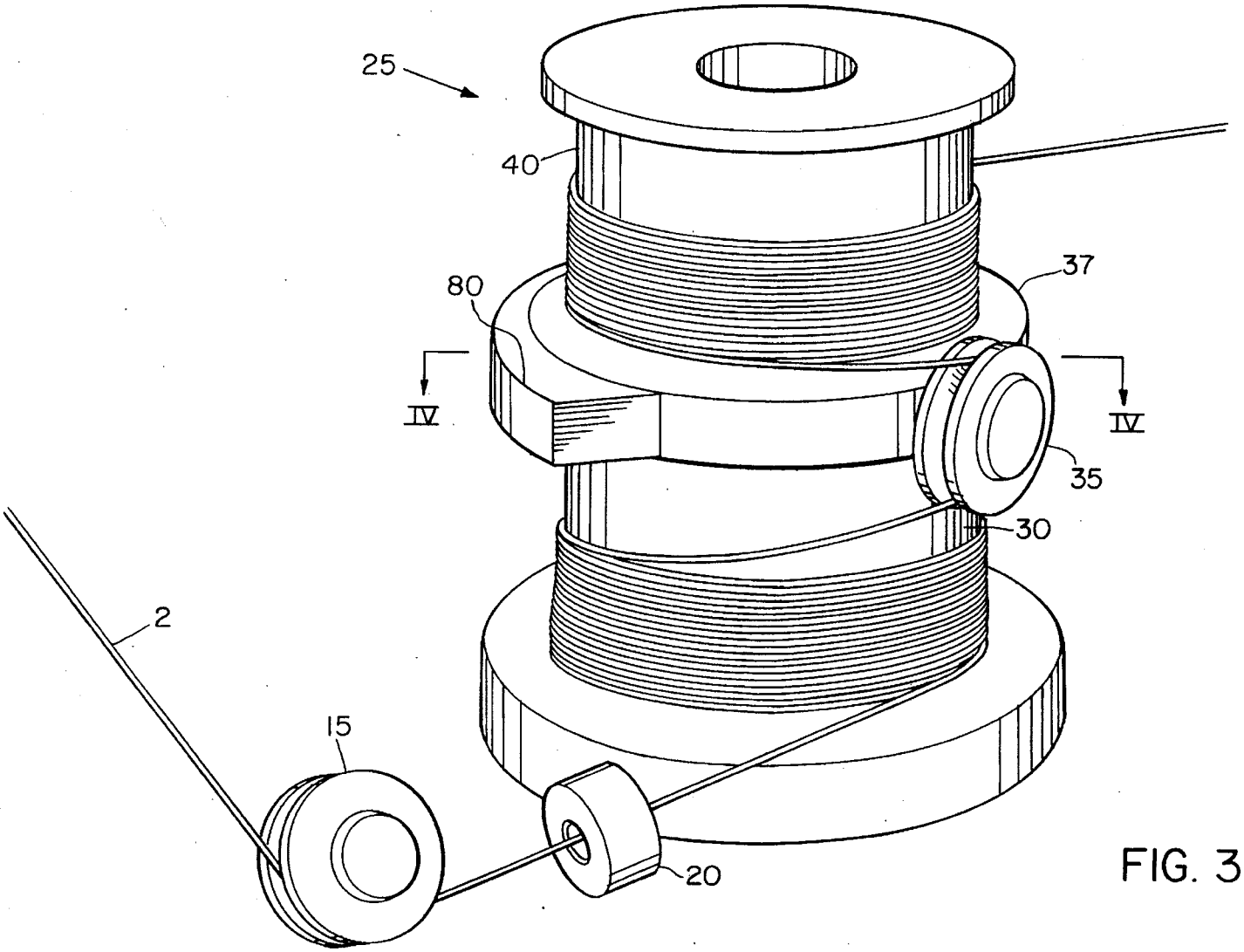
FIG. 3 shows a double-block as in FIG. 1 that has been modified to incorporate the principles of the present invention.

Turning now to FIGS. 3 and 4, improvements in the double-block cumulative wire-drawing machine illustrated in FIGS. 1 and 2 will be described. These improvements can either be incorporated into the existing double-block wire-drawing machines by a retrofit or an entirely new machine.

A double-block constructed according to the principles of the present invention is illustrated in FIG. 3. This double-block is constructed essentially as the double-blocks described in connection with FIG. 1 except that it is additionally provided with a cam 80 on the ring 37. This cam 80 has the effect that the ring 37, through 180° of its arc, has a diameter that is a function of circumferential position. This cam 80 can either be installed on the ring 37 as a retrofit item or can be formed integral with the ring 37.

FIG. 4 is a schematic top cross-sectional view of the double-block of FIG. 2 taken along line IV—IV in combination with a proximity detecting device 82 that is mounted to a rear housing 8 of the wire-drawing machine of FIG. 1. An aperture 84 is formed in the rear housing 8 of the wire-drawing machine. Behind this aperture, an ultrasonic transducer 86 is positioned to emit ultrasonic energy toward the ring 37.

The ultrasonic transducer 86 is substantially as described in connection with FIG. 3 of U.S. Pat. No. 4,199,246, dated Apr. 22, 1980 and incorporated herein by reference. Basically, the transducer 86 in combination with the sonar amplifier and power supply 88 generates a voltage signal on line 90 indicative of the distance between the surface of the cam 80 and the transducer 86. This voltage signal is generated by determining a time it takes for ultrasonic energy to travel from the transducer 86 and be received back at the transducer as an echo reflected from the outer surface of cam 80. Consequently, the control circuitry generates on line 90 a voltage that is a function of the rotational position of the ring 37 between −90° and +90°.

The proximity detector 82, in operation, is calibrated by adjusting the transducer amplification so that the analog signal provided on line 90 is 0 Volts when the ring 37 is placed at 0 degrees. The signal on line 90 is then summed at the summing module 94 with the voltage supplied from the operator's field adjust potentiometer 92. As described in connection with FIG. 2, this signal is operator adjusted to select the desired speed of the motor 110 driving the lower segment 30. In the situation in which the sheave is at zero degrees, the motor drive field regulator 92 controls the speed of the motor 110 since the voltage on line 90 is zero, i.e., the voltage from the regulator 92 is not modified at the summing module 94. If, however, the ring 37 should rotate in a clockwise direction toward the negative 90° position as would result from a decrease in the wire accumulated by the double-block because the motor 110 is not driving the lower segment 30 at a high enough speed, the voltage appearing on line 90 increases. This increase is then summed with the voltage provided from the operator's field adjust potentiometer 92. Thus, a higher voltage is provided to the drive field regulator 100 which in turn drives the motor 110 at a higher speed. Consequently, the double-block 25 will begin to accumulate more wire and the sheave will slowly rotate back to the 0° position. In the opposite case, when the sheave rotates in the counter clockwise direction, the voltage appearing on line 90 will go negative essentially subtracting from the voltage provided by the operator's field adjust potentiometer 92. This will cause a lower voltage to be provided to the drive field regulator 100 which will cause the motor 110 to be driven at a slower speed.

An alarm circuit 120 monitors the output of the sonar amplifier 88 to detect for uncontrolled ring 37 rotation. Basically, the alarm circuit contains a high and low voltage thresholder to detect if the ring has rotated near the −90° or +90° limits. In this event a relay is energized to provide an visible and/or audible indication to an operator of the alarm condition.

Although the invention has thus far been described in relation to the double-block type wire-drawing machine, it is equally applicable to the overhead take-off (OTO) configuration. OTO's are also cumulative-type machines that are similar in construction to double-block machine. Basically, OTO's do away with the upper segments, see reference numeral 40 of FIG. 3, through the utilization of a system of overhead sheaves.

Figure 5:
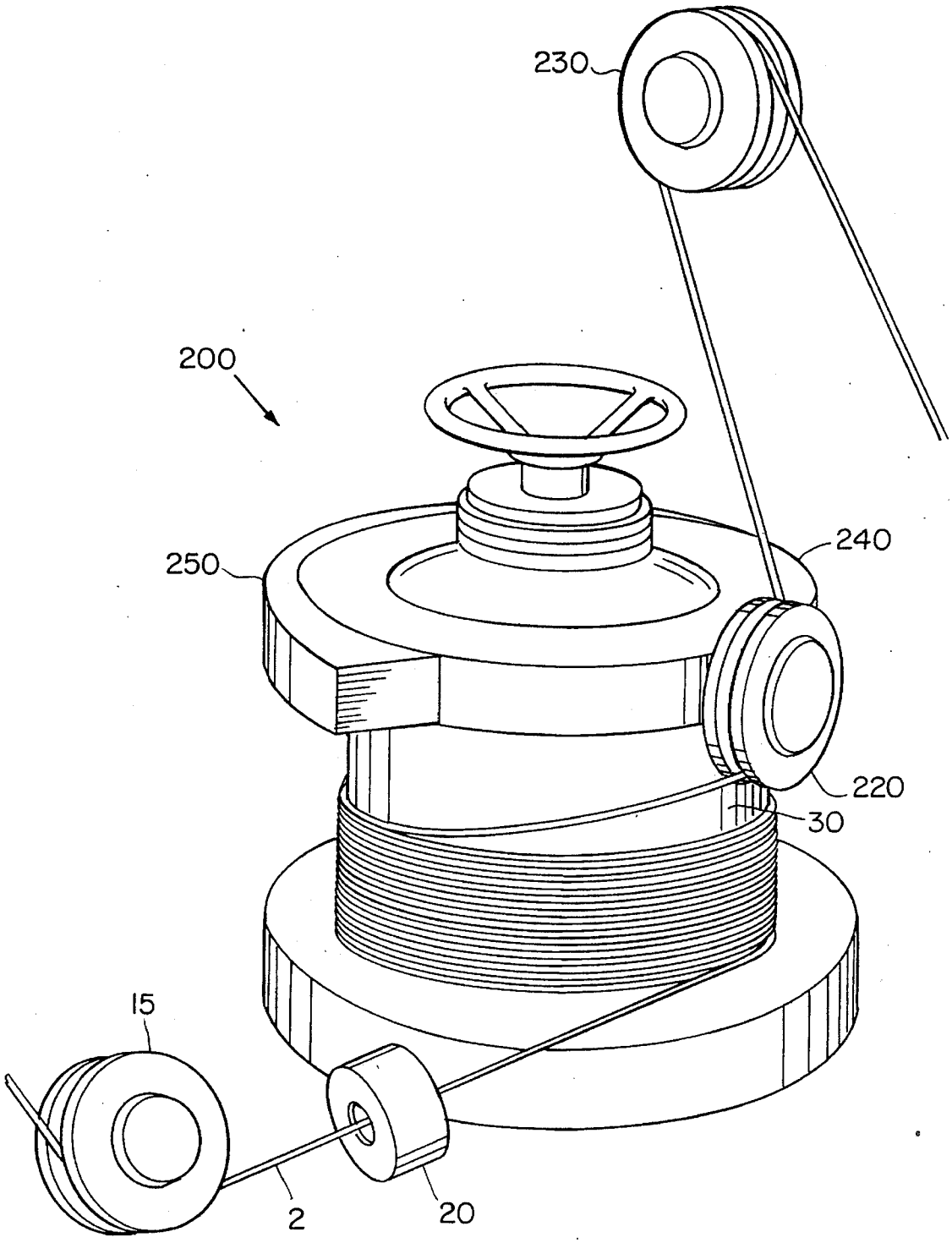
FIG. 5 shows a block for an overhead take-off machine that has been modified to incorporate the principles of the invention.

FIG. 5 illustrates an OTO block 200 that has been modified according to the principles of the present invention. Generally, a number of these OTO blocks would ganged in a multiple-draft machine as illustrated in FIG. 1. As in the double-block configuration, a lower segment 30 is driven by a motor to pull the wire 2 through a die 20. A quantity of wire is accumulated on the lower segment 30 and then taken off via a take-off sheave 220. An overhead sheave 230 then receives the wire 2 from the take-off sheave and directs the wire to the next station.

The take-off sheave 220 is supported on a ring 240 that has an axis of rotation that is coaxial with the axis of rotation of the lower segment 30. As in the double-block 25, it is a characteristic that the ring 240 rotates when the lower segment is either loosening or gaining wire. This rotation is detected and the speed of the lower segment 210 controlled by placing a cam 250 on the ring and a proximity detector on the housing of an OTO wire drawing machine housing as described in connection with FIG. 4. The speed of the motor driving the lower segment is then controlled to keep the ring 210 from rotating also as described in connection with FIG. 4.

While this invention has been particularly shown and described with references to preferred embodiments thereof, it will be understood by those skilled in the art that various changes in form and details may be made therein without departing from the spirit and scope of the invention as defined by the appended claims. For example, optical or magnetic proximity detectors could be used.

What is claimed is:

1. For a cumulative wire-drawing machine including a die for reducing a diameter of wire, a block having a segment for pulling the wire through the die, a sheave for transferring the wire from the segment, a ring for carrying the sheave, and a motor for driving the block, a block speed controlling device comprising:

a cam on the ring;

a proximity detection device mounted on a housing of the wire-drawing machine for detecting rotation of the ring by detecting a distance to a surface of the cam; and a motor speed control for changing the speed of the motor in response to the rotation detected by the proximity detection device.

2. A block speed controlling device as described in claim 1, wherein the ring is adapted to rotate on an axis of rotation of the segment.

3. A block speed controlling device as described in claim 1, wherein the wire-drawing machine further comprises another segment for receiving the wire from the segment via the sheave and providing the wire to a downstream die.

4. A block speed controlling device as described in claim 1, wherein the proximity detection device comprises an ultra-sonic transducer for generating an ultrasonic signal directed at the cam and for detecting an echo signal from the cam.

5. A cumulative wire-drawing machine comprising:

a plurality of dies for successively reducing a diameter of a wire;

a double-block downstream of each one of the dies for pulling the wire through the dies, each one of the double-blocks including a motor, a first segment being driven by the motor to pull the wire through the die, a second segment for providing wire to a downstream double-block through a downstream die, and a sheave for transferring the wire from the first segment to the second segment;

a wire accumulation detecting device associated with each double-block for detecting changes in an amount of the wire accumulated on the double-block and generating a signal indicative of the changes, the wire accumulation detecting device including a cam on a ring that carries the sheave on the double-block and a proximity detection device mounted to a housing of the wire-drawing machine for detecting a distance to a surface of the cam; and a motor speed controlling device for changing a speed of the motor in response to the signal.

6. A wire-drawing machine as described in claim 5, wherein the ring rotates around an axis of rotation of the first segment and the second segment.

7. A wire-drawing machine as described in claim 5, wherein the wire accumulation detecting device detects the changes in the amount of the wire accumulated on the double-block by detecting rotation of the ring.

8. A wire-drawing machine as described in claim 5, wherein the proximity detection device is an ultrasonic transducer for generating an ultrasonic signal directed at the cam and for detecting an echo from the cam.

9. A method for retrofitting a double-block wire-drawing machine for automatic control, comprising the steps of:

installing a cam on a ring carrying a sheave of the double-block wire-drawing machine, the sheave for transferring wire between upper and lower segments of a double-block;

mounting a proximity detection device to a housing of the wire-drawing machine to detect a distance to an outer surface of the cam; and modifying an electrical control circuit of a motor driving the double-block to vary the speed of the double-block in response to a distance to the cam detected by the proximity detection device.

10. A method for controlling double-block speed in a wire-drawing machine, comprising the steps of:

detecting rotation of a ring carrying a sheave for transferring wire between an upper and lower segment of a double-block to determine changes in a quantity of wire accumulated on the double-block by detecting the distance to surface of a cam on the ring; and automatically changing the speed of the motor driving the double-block in response to the changes in the amount of accumulated wire.

11. A cumulative wire-drawing machine comprising:

a plurality of dies for successively reducing a diameter of a wire;

a block downstream of each one of the dies for pulling the wire through the dies and accumulating the wire, each one of the blocks including a motor, a segment being driven by the motor to pull the wire through the die and accumulate the wire, and a sheave for transferring the wire from the segment;

a ring for carrying the sheave;

a cam on the ring; and a proximity detection device for detecting rotation of the ring by detecting a distance to a surface of the cam to determine changes in an amount of wire accumulated on the block and generating a signal indicative of the changes; and a motor speed controlling device for changing a speed of the motor in response to the signal.

12. A cumulative wire-drawing machine as described in claim 11, wherein the ring rotates around an axis of rotation of the segment.

13. A cumulative wire-drawing machine as described in claim 12, wherein the proximity detection device is mounted on the housing of the wire-drawing machine.

14. A cumulative wire-drawing machine as described in claim 11, wherein the block is a double-block.

15. A cumulative wire-drawing machine as described in claim 11, wherein the block is an over-head take-off type block.

16. A method for retrofitting an overhead take-off wire-drawing machine for automatic control, comprising steps of:

installing a cam on a ring carrying a sheave located on the wire-drawing machine, the sheave for transferring wire from a segment of a block of the wire-drawing machine;

mounting a proximity detection device to a housing of the wire-drawing machine to detect a distance to an outer surface of the cam; and modifying an electrical control circuit of a motor driving the block to vary the speed of the block in response to a distance to the cam detected by the proximity detection device.

17. A method for controlling block speed in an overhead take-off wire-drawing machine, comprising steps of:

detecting rotation of a ring carrying a sheave for transferring wire from a segment of the block to determine changes in a quantity of wire-accumulated on a block by detecting a distance to a cam on the ring; and automatically changing the speed of the motor driving the block in response to the changes in the amount of the accumulated wire.

18. A method as described in claim 17, wherein the step of automatically changing the speed of the motor comprises changing the speed of the motor so that the block accumulates a fixed amount of the wire.

* * * * *